US005954580A

United States Patent [19]

Adib et al.

[11] Patent Number: 5,954,580

[45] Date of Patent: Sep. 21, 1999

[54] AIR DIFFUSER AND DAMPER ASSEMBLY

[75] Inventors: Camille Adib, Mount Royal; Boonley Fu, Scarborough, both of Canada

[73] Assignee: Thermolec Ltee., Canada

[21] Appl. No.: 08/976,245

[22] Filed: Nov. 21, 1997

[51] Int. Cl.[6] ..... F24F 13/062

[52] U.S. Cl. ..... 454/311; 454/300

[58] Field of Search ..... 454/292, 298, 454/300, 302, 303, 311, 312, 330, 331, 332

[56] References Cited

U.S. PATENT DOCUMENTS

| | | | |
|---|---|---|---|
| 2,636,668 | 4/1953 | Meyer et al. . | |
| 3,107,597 | 10/1963 | Person | 454/312 X |
| 3,765,316 | 10/1973 | Skoch . | |
| 3,955,483 | 5/1976 | Sunter | 454/332 |
| 4,817,508 | 4/1989 | Prochnow . | |
| 5,117,745 | 6/1992 | Prochnow et al. | 454/300 |

*Primary Examiner*—Harold Joyce
*Attorney, Agent, or Firm*—Holland & Knight LLP

[57] ABSTRACT

The air diffuser of this assembly has a top collar with a free edge and the damper is of conventional construction, having a central core and a set of radially outwardly extending strut arms. In the central core is mounted a vertical actuating screw for adjusting the air deflector blades of the damper. The outer ends of the strut arms are formed with a stop member resting over the top edge of the diffuser collar and with a system to deform the collar walls so as to lock the strut arms to the collar against axial movement and against rotation. The stops serve to locate the damper in its proper operative position so as to direct the air uniformly over the air diffuser baffles.

18 Claims, 4 Drawing Sheets

AIR DIFFUSER AND DAMPER ASSEMBLY

FIELD OF THE INVENTION

The present invention relates to a system for assembling an air ducting member such as an air diffuser with an apparatus such as an air damper.

BACKGROUND OF THE INVENTION

Opposed blade air dampers are currently assembled with air diffusers by means of fasteners specially sheet metal screws requiring drilling of the collar wall of the air diffuser and of the outer ends of the strut arms of the air damper and screwing the strut arms to the air diffuser collar with metal screws. This is a cumbersome and time-consuming operation so much so that the axis of the air damper must coincide with the axis of the air diffuser for proper operation of the assembly namely uniform diffusion of the air within the room all around the air diffuser. This, therefore, requires precise location of the holes drilled in the strut arms of the air damper and in the collar of the air diffuser.

U.S. Pat. No. 4,817,508 dated Apr. 4, 1989 entitled "OPPOSED BLADE BALANCED DAMPER", inventor Kenneth PROCHNOW, describes (referring to FIGS. 3 and 4) a system of tabs 44 with pointed ends 46, 48 at the ends of struts 26 which engage a groove in the interior of an air duct 12 to support the damper frame 20. However, in this system, the tabsprongs 44 depend from downwardly extending legs 42 secured to the struts 26 and the points 46, 48 cannot be forced to deform the air duct wall at the bottom of the groove axis coinciding with the axis of the duct 12. It follows that the damper assembly is not positively held within the duct 12 against axial movement and rotation.

OBJECTS OF THE PRESENT INVENTION

The general object of the present invention is to provide a fastener system which simplifies the assembly of an air ducting member such as an air diffuser with an apparatus such as an air damper, the system of the invention eliminating the requirement of drilling holes and screwing metal screws and requiring only the use of a hammer or a pair of pliers to effect the assembly of the two parts in a very simple and efficient manner and such that the axis of the air damper or the like apparatus will coincide with the axis of the air diffuser or the like air ducting member.

Another object of the present invention relates to a system of the character described wherein the wall of one part is caused to be deformed during assembly so as to positively lock the two parts together while allowing disassembly without damaging the same.

SUMMARY OF THE INVENTION

The assembly of the present invention comprises an air ducting member including a collar formed of an apertureless collar wall having a collar free edge, an apparatus positioned within said collar and including at least three equally angularly spaced radial strut arms directed towards said collar, and securing means carried by the outer ends of said strut arms to secure said strut arms to said collar, said securing means including stops integrally formed by said outer ends, overlying and resting on said collar free edge to determine the axial position of said apparatus within said collar, and collar wall deforming means integrally formed by said outer ends and forcibly engaged with and deforming said collar wall, said stops and wall deforming means preventing movement of said apparatus relative to said collar.

Preferably, each of said stops has a collar free edge engaging face located radially inwardly of said collar wall and an extension depending from said stop on the outside of said collar wall and having an inclined edge having a first portion located inwardly of said collar wall and meeting with said face and a second portion located opposite said collar wall, radially outwardly thereof, said extension and its inclined edge constituting said collar wall deforming means and the outer end of each of said strut arms form a straight edge normal to the longitudinal axis of said strut arm, co-planar with the axis of said collar and engaging the inside of said collar wall, said stop extension radially outwardly protruding from said collar wall and extending opposite the latter.

In accordance with other embodiments of the present invention, collar wall deforming means include laterally bendable radially outwardly extending pointed prongs formed by the outer end of each strut arm, each prong capable of taking a position co-planar with said strut arm and in which the points of said prongs interfere with said collar wall.

More specifically, said air ducting member is an air diffuser and said apparatus is an air damper, said air damper having an air deflector blades actuating screw coaxial with the axis of said collar, said air diffuser including a flared skirt depending from said collar and spacedly superposed air baffles within said skirt and secured to the latter and, each of said stops has a collar free edge engaging face, the faces of all of said stops lying in a common plane normal to said screw.

BRIEF DESCRIPTION OF THE DRAWINGS

In the annexed drawings, wherein like reference numerals indicate like elements throughout.

DETAILED DESCRIPTION OF THE PREFERRED EMBODIMENTS

Figure 1:
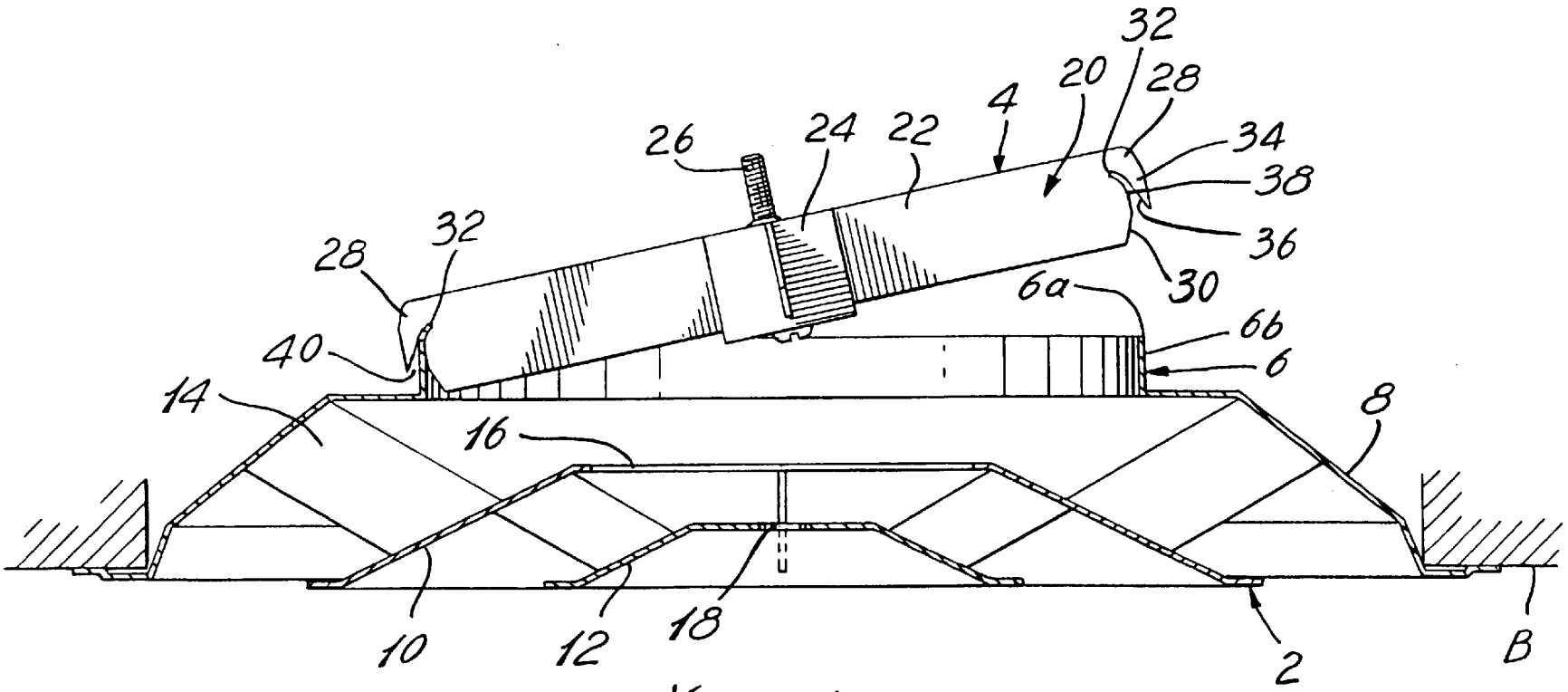
FIG. 1 is a cross-section of an air diffuser installed in a hole in a ceiling and also showing part of the frame of an air damper being installed on the collar of the air diffuser.

The present invention is directed to the assembly of an air diffuser 2 with an air damper 4 such as used in building air heating and cooling systems.

The air diffuser 2 is connected to an air duct indicated at A and being installed in a hole made in a room ceiling B. Both parts 2 and 4 are made of sheet metal.

Air diffuser 2 is of the type including a collar 6 with a free top edge 6*a*, the collar being defined by a collar wall 6*b*. The collar has a depending flared skirt 8. Superposed and spaced top air baffle 10 and bottom air baffle 12 are connected to skirt 8 by means of connecting strips 14. These baffles are downwardly and outwardly flaring having a generally frusto-conical shape. The top baffle 10 has a central opening 16 so that the air downwardly directed from the air duct A can pass therethrough and be outwardly diffused by the bottom air baffle 12.

The air damper 4 is of conventional construction and only its mounting frame 20 is shown in the drawings, said frame including four angularly equally spaced radial strut arms 22 each formed by a metal strip secured to a central core 24 in which is mounted an air deflector blade actuating screw 26, said screw adapted to be exposed through a central hole 18 of air baffle 12 so as to be accessible for rotation by a screw driver or the like so as to adjust the angle of the conventional air deflector blades (not shown). A stop 28 outwardly protrudes from the outer end 30 of each strut arm 22. Each stop 28 has, at its underside, a collar free edge engaging face 32 adapted to rest on the collar top edge 6*a* with the stop radially extending outwardly beyond the collar wall 6*b*. Each outer end 30 further includes an integral stop extension 34 defining an inclined edge 36 which radially inwardly and upwardly extends when the air damper 4 is assembled with the air diffuser 2. The outer end 30 of each strut arm 22 further includes a straight edge 38 which is vertical and engages the inside of the collar wall 6*b* and is upwardly extended by a slit 40 also defined by the inclined edge 36.

Damper 4 is assembled with air diffuser 2 as follows: the air diffuser is positioned on the floor or on a table and the air damper frame 20 is hooked to the collar wall 6*b* in inclined position through the slit 40 of one of the strut arms 22 as shown in FIG. 1, then the remaining strut arms are hammered down onto the collar wall 6*b* so that the latter will engage the inclined slits 40 of all the strut arms 22 and be inwardly deformed by the inclined edges 36 as shown at 42 in FIGS. 2 and 3. Strut arms 22 are hammered down until faces 32 rest on top edge 6*a* of collar 6.

Figure 2:
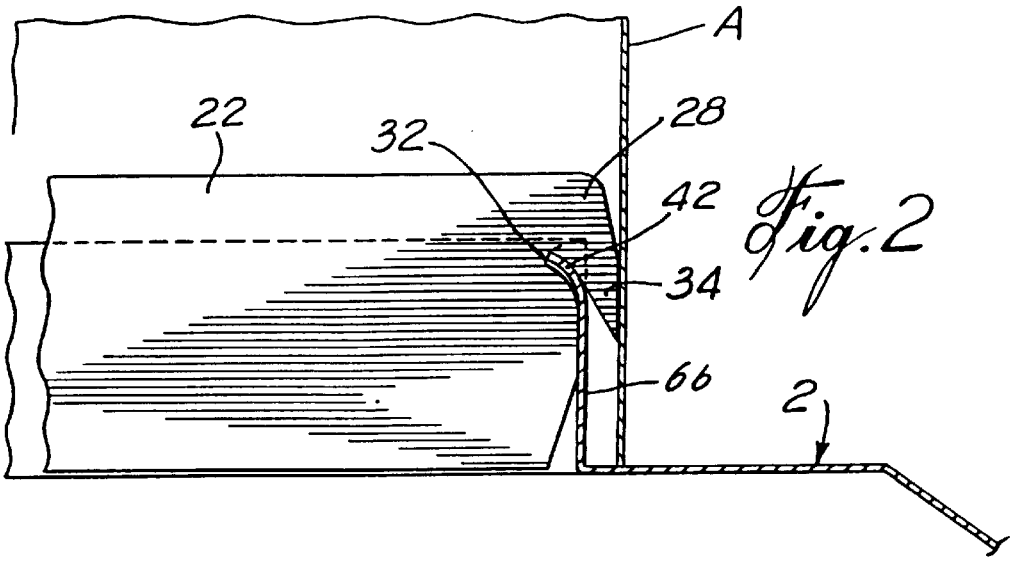
FIG. 2 is a vertical section of part of the air diffuser and air damper showing one strut arm of the air damper locked to the collar of the air diffuser; and also showing an air duct telescoped over the assembly.
Figure 3:
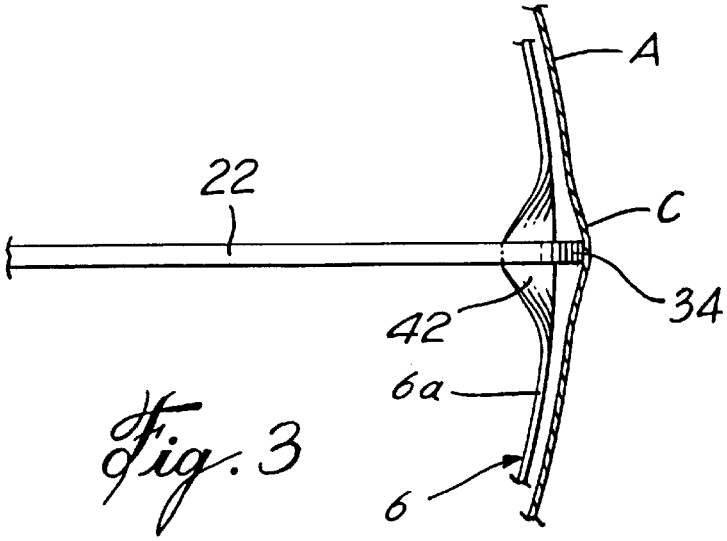
FIG. 3 is a partial plan section of the strut arm locked to the collar and showing the air duct in cross-section.
Figure 4:
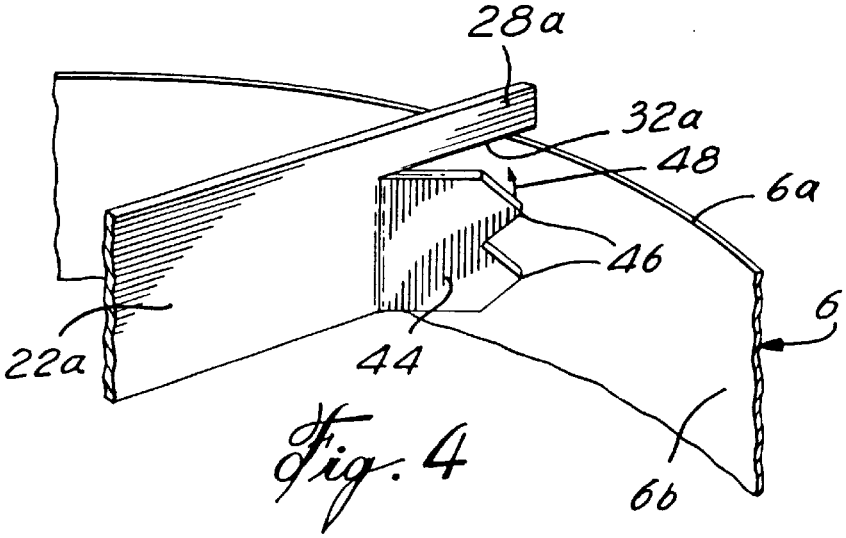
FIG. 4 is a partial perspective view of a second embodiment showing the means for locking the air damper strut arm to the collar.
Figure 5:
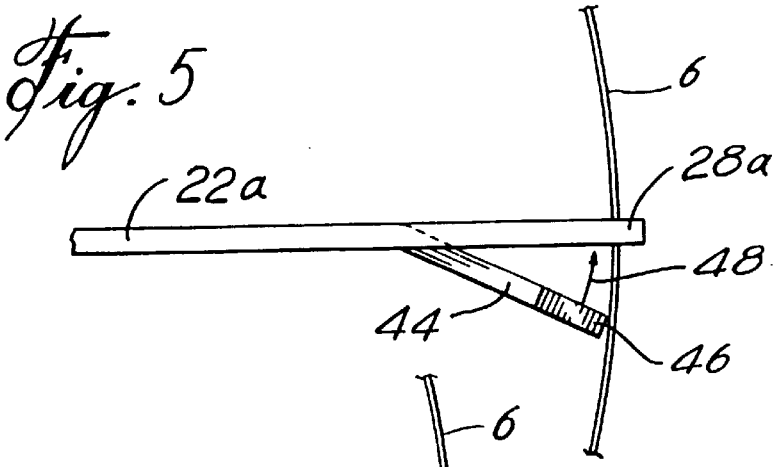
FIGS. 5 and 6 are top plan views of the arrangement of FIG. 4 showing the locking prong in collar releasing and collar engaging position respectively.

The assembled parts are then telescoped within the air duct A and the outer edges of the extensions 34 may cause slight deformation of the wall of the air duct as shown in FIGS. 2 and 3 to help locking the assembly of the air diffuser and air damper within the air duct A.

It will be noted that all the collar free edge engaging faces 32 lie in a common plane normal to the axis of the actuating screw 26 and it follows that stops 28 serve to automatically locate the air damper 4 in proper position within the air diffuser collar 6 so that the air will be equally diffused by the latter, the axis of screw 26 coinciding with that of the air diffuser.

The deformed portions 42 of the collar wall 6*b* positively prevent axial as well as rotational movement of the air damper relative to the air diffuser collar 6. The use of a hammer is all that is required to assemble and lock the two parts 2 and 4 together. The assembled parts are then simply pushed upwardly to be telescoped within the air duct A and may be positively frictionally retained in the latter due to a slight outward deformation of the air duct wall by the stop extensions 34 as shown at C in FIG. 3.

Figure 6:
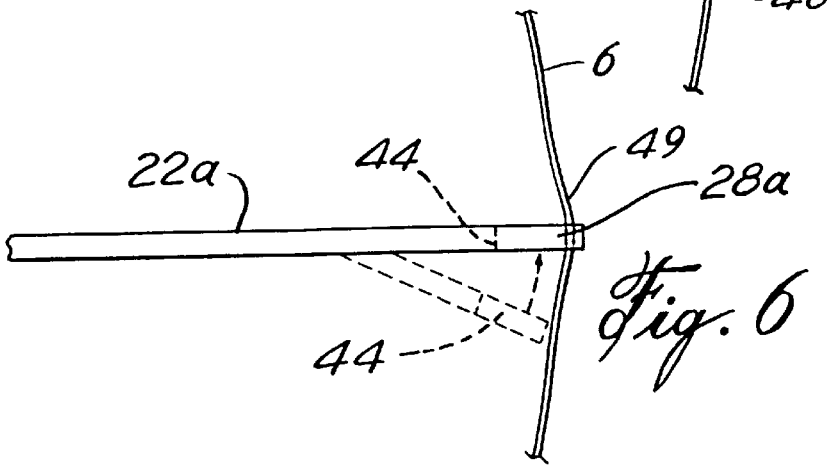
Figure 7:
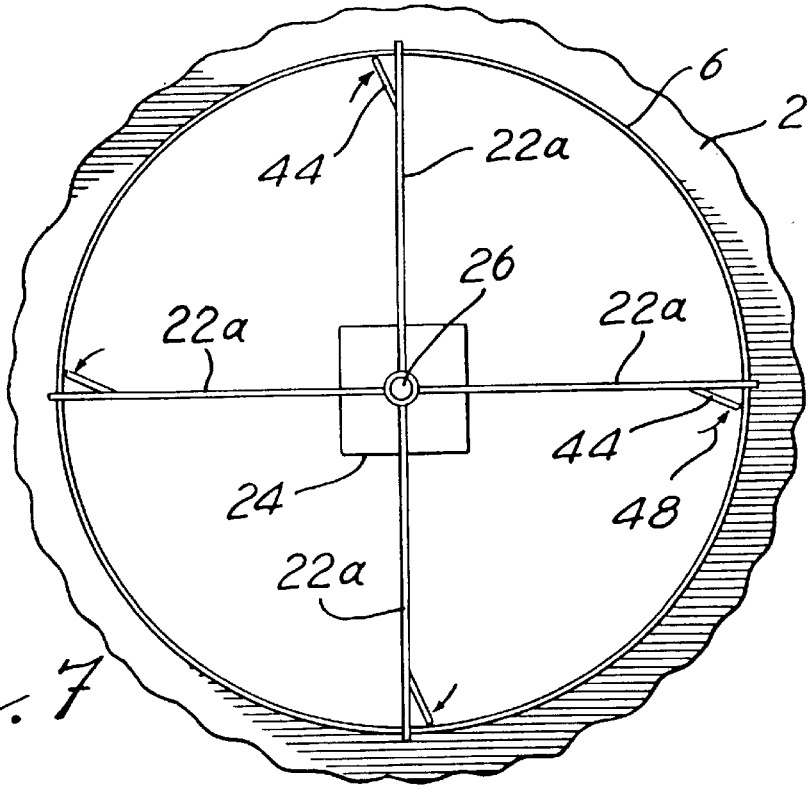
FIG. 7 is a top plan view of the air diffuser and showing the strut arms of the air damper being locked to the air diffuser collar.

FIGS. 4 to 7 show a second embodiment of the invention. Here again, each strut arm 22*a* of the air damper frame is formed at its outer end with an outwardly protruding integral stop 28*a* having a lower collar free edge engaging face 32*a* which rests on the top edge 6*a* of the collar wall 6*b*. Underneath each stop 28*a*, the outer end of the strut arm 22*a* forms a prong 44 which is partially stamped out of the strut arm and which is formed with two prong points 46. These prongs 44 are laterally bendable from a laterally extending position shown in FIG. 4 towards a position co-planar with the strut arm as shown by the arrows 48 in FIGS. 5 and 6. In this latter position, the points 46 push the collar wall 6*b* outwardly so as to deform the latter and lock the air damper to the collar of the air diffuser; the resulting wall deformation 49 is shown in FIG. 6. Here again, the faces 32*a* lie in a common plane perpendicular to the actuating screw 26 carried by the air damper 4.

Figure 9:
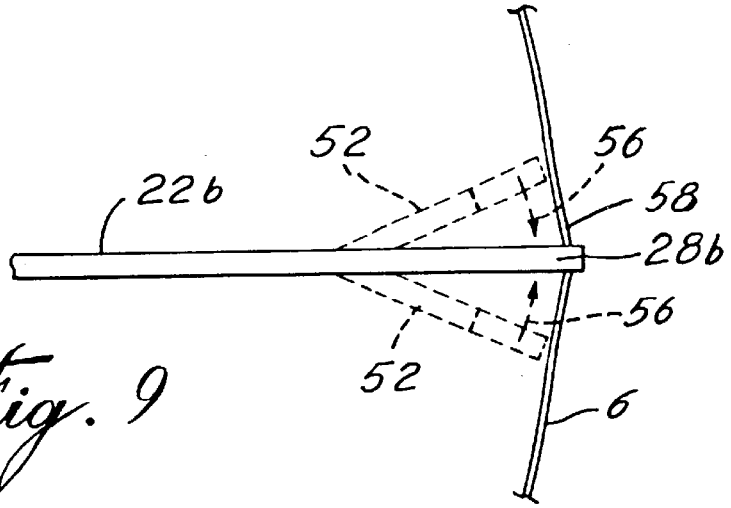
FIG. 9 is a top plan view of the arrangement of FIG. 8.
Figure 10:
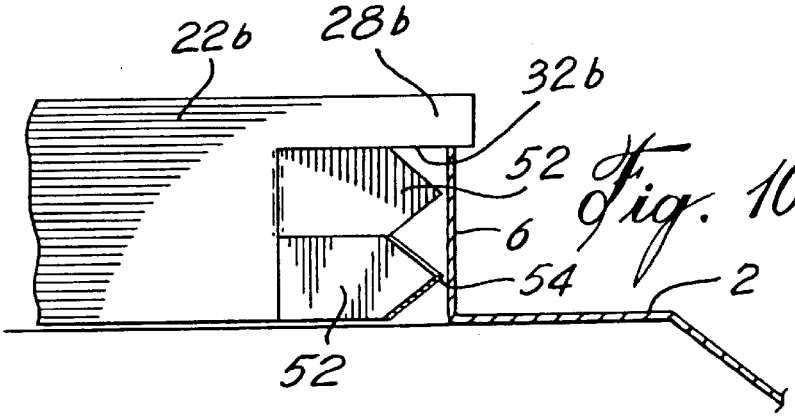
FIG. 10 is a side elevation of the strut arm of FIG. 8 and showing the air diffuser in partial cross-section.
Figure 8:
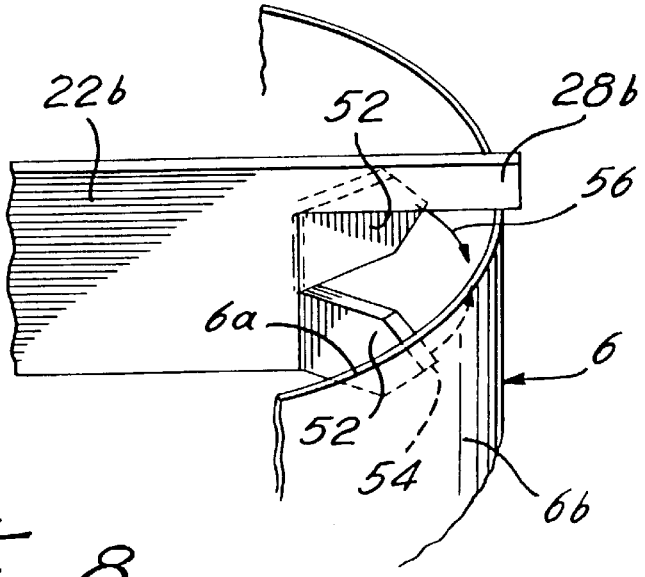
FIG. 8 is a perspective view of a third embodiment of an air damper's strut arm with a pair of oppositely directed locking prongs.

FIGS. 8 to 10 show a third embodiment wherein two prongs 52 instead of having just one bendable prong 44 are partially stamped at the outer end of each strut arm. More particularly, as shown in FIG. 8, the strut arm 22*b* has a stop 28*b* protruding from the outer end of the strut arm and having an underlying edge face 32*b* adapted to rest on the top edge 6*a* of collar 6. The two prongs 52 extend under the stop 28*b*, and each prong has one point 54. Initially the prongs 52 extend on opposite sides of the strut arm and can be bent towards a position co-planar with the strut arm in accordance with arrows 56, in which latter position the two prong points 54 interfere with the collar wall 6*b* so as to firmly engage and deform the latter as shown at 58 to lock the air damper 4 to the collar of the air diffuser 2.

For the second and third embodiments, only a pair of pliers are necessary to bend the prongs into locking and wall deforming engagement with the collar wall 6*b* of the air diffuser.

In all embodiments, it is clear that even if collar 6 has an actual diameter which slightly varies from its nominal diameter, proper assembly can still be achieved. For instance, a collar 6 of a diameter within the limits of 7.75 to 7.95 inches can be assembled with a damper frame 20 designed for a nominal diameter collar of 8.0 inches.

Obviously, the same assembly system can be used for other types of apparatuses than an air diffuser and an air damper, namely for assembling any air ducting member featuring an apertureless collar wall and a collar free edge, with any type of apparatus to be positioned within the collar and including at least three equally angularly spaced radial strut arms directed towards the collar. The assembly is effected by securing means which are carried by the outer ends of the strut arms and serve to secure the latter to the collar, the securing means including the stops as above mentioned which overlie and rest on the collar top free edge to determine the position of the apparatus within the collar and further including collar wall deforming means integrally formed by the outer ends of the strut arms to forcibly engage with and deform the collar wall, the stops and wall deforming means positively preventing movement of the apparatus relative to the collar.

We claim:

1. An assembly comprising an air ducting member including a collar formed of an apertureless collar wall having a collar free edge, an apparatus positioned within said collar and including at least three equally angularly spaced radial strut arms directed towards said collar, and securing means carried by the outer ends of said strut arms to secure said strut arms to said collar, said securing means including stops integrally formed by said outer ends, overlying and resting on said collar free edge to determine the axial position of said apparatus within said collar, and collar wall deforming means integrally formed by said outer ends and forcibly engaged with and deforming said collar wall, said stops and wall deforming means preventing movement of said apparatus relative to said collar.

2. The assembly as defined in claim 1 wherein said air ducting member is an air diffuser and said apparatus is an air damper, said air damper having an air deflector blades actuating screw coaxial with the axis of said collar, said air diffuser including a flared skirt depending from said collar and spacedly superposed air baffles within said skirt and secured to the latter.

3. The assembly as defined in claim 2, wherein each of said stops has a collar free edge engaging face, the faces of all of said stops lying in a common plane normal to said screw.

4. The assembly as defined in claim 1, wherein each of said stops has a collar free edge engaging face located radially inwardly of said collar wall and an extension depending from said stop on the outside of said collar wall and having an inclined edge having a first portion located inwardly of said collar wall meeting with said face and a second portion located opposite said collar wall, radially outwardly thereof, said extension and its inclined edge constituting said collar wall deforming means.

5. The assembly as defined in claim 2, wherein each of said stops has a collar free edge engaging face located radially inwardly of said collar wall and an extension depending from said stop on the outside of said collar wall and having an inclined edge having a first portion located inwardly of said collar wall and meeting with said face and a second portion located opposite said collar wall, radially outwardly thereof, said extension and its inclined edge constituting said collar wall deforming means.

6. The assembly as defined in claim 5, wherein all the collar free edge engaging faces of said stops lie in a common plane normal to said screw.

7. The assembly as defined in claim 4, wherein the outer end of each of said strut arms form a straight edge normal to the longitudinal axis of said strut arm, co-planar with the axis of said collar and engaging the inside of said collar wall, said stop extension radially outwardly protruding from said collar wall and extending opposite the latter.

8. The assembly as defined in claim 7, wherein said air ducting member is an air diffuser and said apparatus is an air damper, said air damper having an air deflector blades actuating screw coaxial with the axis of said collar, said air diffuser including a flared skirt depending from said collar and spacedly superposed air baffles within said skirt and secured to the latter.

9. The assembly as defined in claim 8,wherein the collar free edge engaging faces of all the stops lie in a common plane normal to said screw.

10. The assembly as defined in claim 1, wherein said collar wall deforming means include laterally bendable radially outwardly extending pointed prongs formed by the outer end of each strut arm, each prong capable of taking a position co-planar with said strut arm and in which the points of said prongs interfere with said collar wall.

11. The assembly as defined in claim 2, wherein said collar wall deforming means include laterally bendable, radially outwardly extending pointed prongs formed by the outer end of each strut arm, each prong capable of taking a position co-planar with said strut arm and in which the points of said prongs interfere with said collar wall.

12. The assembly as defined in claim 3, wherein said collar wall deforming means include laterally bendable radially outwardly extending pointed prongs formed by the outer end of each strut arm, each prong capable of taking a position co-planar with said strut arm and in which the points of said prongs interfere with said collar wall.

13. The assembly as defined in claim 10, wherein there are two prongs for each strut arm laterally bendable from opposite sides of said strut arm towards said co-planar position.

14. The assembly as defined in claim 13, wherein said air ducting member is an air diffuser and said apparatus is an air damper, said air damper having an air deflector blades actuating screw coaxial with the axis of said collar, said air diffuser including a flared skirt depending from said collar and spacedly superposed air baffles within said skirt and secured to the latter.

15. The assembly as defined in claim 14, wherein each of said stops have a collar free edge engaging face, the faces of all of said stops lying in a common plane normal to said screw.

16. The assembly as defined in claim 10, wherein there is one double-pointed prong for each strut arm.

17. The assembly as claimed in claim 16, wherein said air ducting member is an air diffuser and said apparatus is an air damper, said air damper having an air deflector blades actuating screw coaxial with the axis of said collar, said air diffuser including a flared skirt depending from said collar and superposed air baffles within said skirt and secured to the latter.

18. The assembly as defined in claim 17, wherein each of said stops has a collar free edge engaging face, the faces of all of said stops lying in a common plane normal to said screw.

* * * * *